US008157462B2

(12) United States Patent
Hirabayashi

(10) Patent No.: US 8,157,462 B2
(45) Date of Patent: Apr. 17, 2012

(54) OPERATING MECHANISM FOR A PRINTER COVER, AND A PRINTER

(75) Inventor: Kenichi Hirabayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 614 days.

(21) Appl. No.: 12/322,573

(22) Filed: Feb. 4, 2009

(65) Prior Publication Data

US 2009/0202286 A1 Aug. 13, 2009

(30) Foreign Application Priority Data

Feb. 7, 2008 (JP) ..... 2008-027302

(51) Int. Cl.
*B41J 29/02* (2006.01)

(52) U.S. Cl. ..... 400/693.1; 400/693; 399/110; 399/125; 271/9.1

(58) Field of Classification Search ..... 400/691, 400/692, 693; 399/110, 125, 375, 380; 271/9.1
See application file for complete search history.

(56) References Cited

U.S. PATENT DOCUMENTS 4,580,361 A * 4/1986 Hillstrom et al. ..... 40/603
6,022,158 A 2/2000 Nakayama et al.
6,155,730 A 12/2000 Nakayama et al.
6,474,883 B1 * 11/2002 Kawakami et al. ..... 400/613
7,563,045 B2 7/2009 Nagata
2007/0065222 A1 * 3/2007 Nagata ..... 400/693

FOREIGN PATENT DOCUMENTS

CN 1222886 A 7/1999
CN 1935524 A 3/2007
JP 2001-205896 7/2001
JP 2001-213552 8/2001
JP 2007-203563 8/2007
JP 2007-203564 8/2007

* cited by examiner

*Primary Examiner* — Seung Lee
*Assistant Examiner* — Christle Marshall
(74) *Attorney, Agent, or Firm* — Nutter McClennen & Fish LLP; John J. Penny, V.

(57) ABSTRACT

The mechanism for opening and closing an operating cover of a printer having a discharge guide that remains in the same posture while moving in conjunction with opening and closing the operating cover prevents the gap between the discharge guide and the cover case of the operating cover from widening when the operating cover opens and closes. In a roll paper printer 1, the top end part 32*a* of the cover case 32 of an operating cover 3 is pivotably attached on the side of the discharge guide 5, which remains in the same posture while moving in conjunction with the cover 3 opening and closing. So that the cover case 32 does not separate from the cover frame 31 when the cover 3 opens and closes, a torsion spring 37 constantly urges the cover case 32 to open and close in unison with the cover frame 31 through an intervening connector arm 34. When the cover 3 opens and closes, a large gap is not formed between the top end part 32*a* of the cover case 32 and the discharge guide 5, and this gap does not increase in conjunction with the cover 3 opening and closing.

15 Claims, 4 Drawing Sheets

OPERATING MECHANISM FOR A PRINTER COVER, AND A PRINTER

BACKGROUND OF THE INVENTION

1. Field of Invention

The present invention relates to a mechanism for operating a cover that opens and closes the opening to a paper storage compartment rendered in a printer, and relates more particularly to improving the construction of a cover operating mechanism enabling a paper discharge guide or other moving member to open and close in conjunction with the cover opening and closing.

2. Description of Related Art

Roll paper printers used for printing receipts, for example, use roll paper having a single long web of paper wound into a roll as the recording (printing) medium. The roll paper supply mechanism used in such roll paper printers is often a so-called "drop-in loading" mechanism in which the roll paper simply rests and rotates freely on the bottom of the roll paper compartment instead of the roll paper being supported on a roll paper spindle that passes through the core of the roll so that the roll paper can rotate freely. This drop-in loading mechanism makes replacing or loading the roll paper easy because there is no need to mount or dismount the roll paper from the support spindle when replacing the roll paper.

With most drop-in loading roll paper printers opening the cover that opens and closes to access the roll paper compartment also opens the roll paper transportation path. When replacing the roll paper, the paper leader pulled from the roll paper must be set between a pair of paper transportation rollers, between the print head and the platen, and out from the paper exit. When the platen and paper feed rollers are opened together with the cover, the paper is pulled through the now open paper transportation path, and the cover is again closed, the printing paper is automatically threaded through the paper transportation path and ready for printing. The roll paper can thus be easily replaced and loaded in the transportation path by simply opening the cover, replacing the roll paper, pulling a leader out from the roll paper, and then closing the cover again.

A four-node parallel linkage mechanism is commonly used as the mechanism for opening and closing this operating cover in a roll paper printer rendered so that the paper transportation path can be opened by opening the cover. When the cover opens, the four-node parallel linkage mechanism and the platen fold together on the access cover so that the roll paper compartment can be opened widely. Japanese Unexamined Patent Appl. Pub. JP-A-2007-203563 and Japanese Unexamined Patent Appl. Pub. JP-A-2007-203564 teach roll paper printers having a drop-in loading roll paper supply mechanism that uses a four-node parallel linkage mechanism to open and close the paper transportation path in conjunction with the access cover.

The operating access cover of this type of roll paper printer includes a cover frame that is attached to the front parallel links of the four-node parallel linkage mechanism, and a cover case that covers the front side of this cover frame. The connection link connecting the front parallel links to the rear parallel links of this four-node parallel linkage mechanism is rendered by the platen frame, and a discharge guide for discharging the printed paper from the paper exit is attached to the front end of this platen frame. When the access cover is opened, the user unlocks the cover lock mechanism and then pulls forward on the discharge guide to open the cover.

For example, when an opening to the roll paper compartment is formed in the front of the printer, the access cover opens by pivoting at the bottom end thereof to drop forward from an upright closed position to an open position. When the cover opens, the cover pivots forward on a pivot point at its bottom end, and the discharge guide attached to the front end part of the platen frame moves forward while remaining level. The top end part of the cover case is positioned below the discharge guide. When the cover opens, the top end part of the cover case, which tilts forward pivoting at its bottom end, separates from the bottom of the discharge guide that moves forward while remaining level, and the gap between the top of the cover case and the discharge guide widens. Dust and other foreign matter can easily and undesirably enter the roll paper compartment through this gap.

SUMMARY OF THE INVENTION

The present invention provides a mechanism for a printer cover that opens and closes and has disposed to the cover a moving member that remains in the same posture while moving in conjunction with the opening and closing action of the cover rendered so that the gap between a moving member and the case of a cover that opens and closes does not widen when the cover opens and closes.

An operating mechanism for a printer cover according to the present invention includes an operating cover for opening and closing an opening formed in the printer, and a moving member that moves in conjunction with the operating cover. The operating cover has a cover frame that can open and close pivoting on a frame-side pivot axis of the printer, a cover case that covers the cover frame, and an urging member that urges the cover case toward the cover frame. The cover case attached to the moving member pivotably toward and away from the cover frame on the member-side pivot axis of the moving member parallel to the frame-side pivot axis.

The invention disposes the cover case so that it can pivot on the side of the moving member, and an urging member constantly urges the cover case so that it does not separate from the cover frame. Because the pivot axis of the cover case is located on the moving member, when the operating cover is opened and closed, a gap is not opened between the cover case and the moving member, which is held in the same posture when it moves. In addition, because the urging member constantly urges the cover case to the cover frame, the cover case always opens and closes in unison with the cover frame.

In order to open and close the cover case in unison with the cover frame without the cover case separating from the cover frame, a connector arm is preferably used to connect the cover case to the printer or cover frame. This connector arm is pivotably connected to the printer or cover frame on a first axis that is parallel to the frame-side pivot axis, and is further connected to the cover case pivotably on a second axis that is parallel to the member-side pivot axis and movably bidirectionally in a direction perpendicular to the member-side pivot axis, and the urging member urges the cover case through the intervening connector arm.

This connection between the connection arm and cover case can be rendered by forming a slide channel in the cover case or the connector arm, and disposing a slide pin to the other of the cover case and the connector arm so that the slide pin can be inserted pivotably and slidably in the slide channel.

In order for the operating cover to open and close between the vertical upright closed position and the open position tilting in front of the printer, a four-node parallel linkage mechanism including front parallel links, back parallel links, and a connection frame spanning between end parts of the front parallel links and end parts of the back parallel links is used. The parallel linkage mechanism enables opening and closing the operating cover between a vertical upright closed position and an open position tilted to the printer front, the cover frame is attached to the front parallel links, and the moving member is attached to the front end part of the connection frame.

When the invention is applied to a drop-in loading type roll paper printer, the connection frame is a platen frame having a platen surface, and the moving member is a discharge guide attached to the front end part of the platen frame. When the operating cover is closed, the platen surface is opposite a print head disposed to the printer, and the discharge guide can guide the printing paper after the paper is printed.

When the invention is thus applied to a roll paper printer and a roll paper compartment is rendered inside the printer, the connection frame is a platen frame having a platen surface, the moving member is a discharge guide attached to the front end part of the platen frame. When the operating cover is closed, the platen surface is opposite a print head disposed to the printer, and the discharge guide can guide the printing paper after the paper is printed.

Another aspect of the invention is a printer having an operating cover for opening and closing an opening, and a moving member that moves in conjunction with the operating cover. The operating cover includes a cover frame that can open and close pivoting on a frame-side shaft on the printer, a cover case that covers the cover frame, and an urging member that urges the cover case toward the cover frame, and the cover case is attached to the moving member pivotably toward and away from the cover frame on a member-side shaft of the moving member.

The operating mechanism according to the present invention for a printer cover that opens and closes attaches the cover case of the operating cover pivotably on the side of a moving member that is held in the same posture as it moves in conjunction with opening and closing the operating cover. When the operating cover opens and closes, the cover case pivots on an axis on the moving member side, and the urging member holds the cover case so that the cover case always opens and closes in unison with the cover frame. Therefore, when the operating cover opens and closes, a large gap does not open between the cover case the moving member, and this gap does not widen in conjunction with the operating cover opening and closing. Dust and other foreign matter therefore does not enter through this gap into the roll paper compartment, and consistent print quality can be maintained.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of an operating mechanism for an operating cover of a printer according to the present invention is described below with reference to the accompanying figures.

General Configuration

Figure 1:
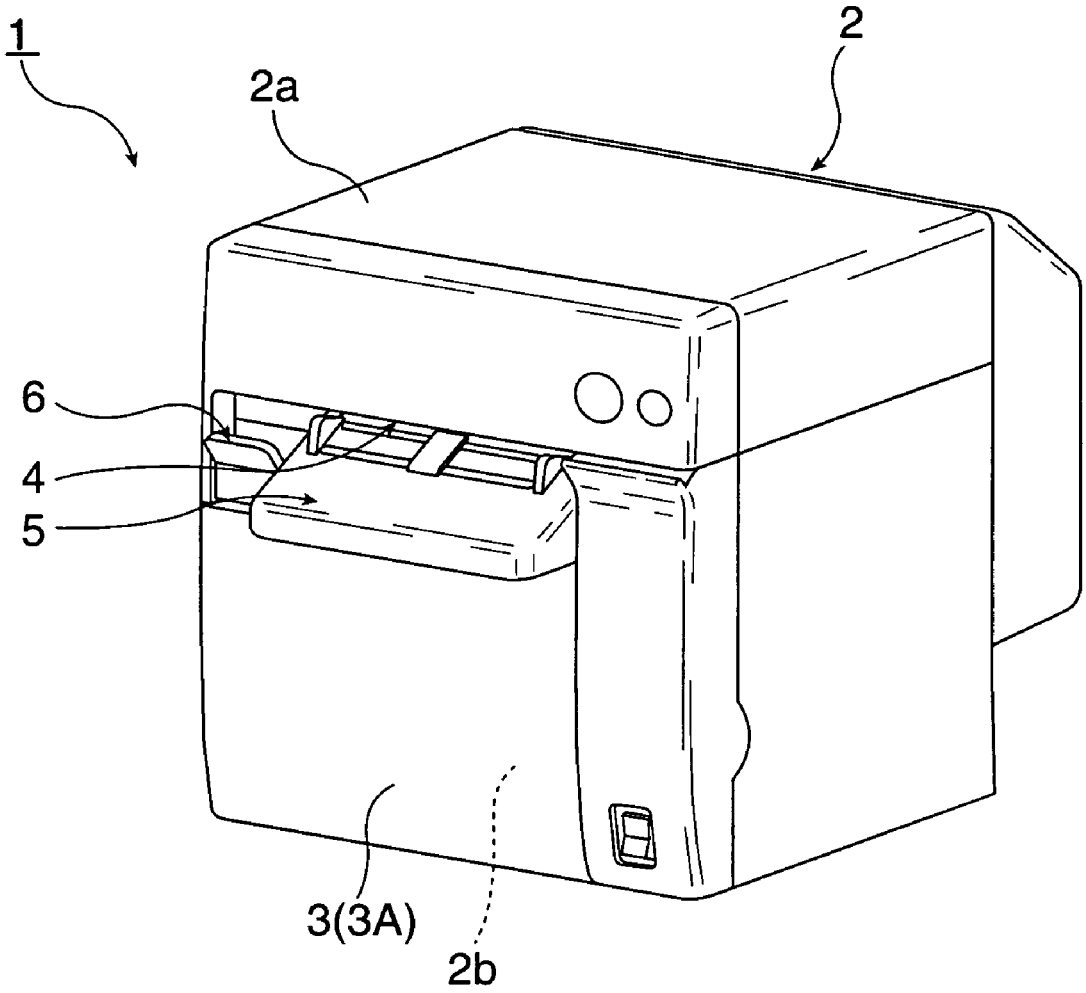
FIG. 1 is an external oblique view of a roll paper printer according to a preferred embodiment of the invention.
Figure 2:
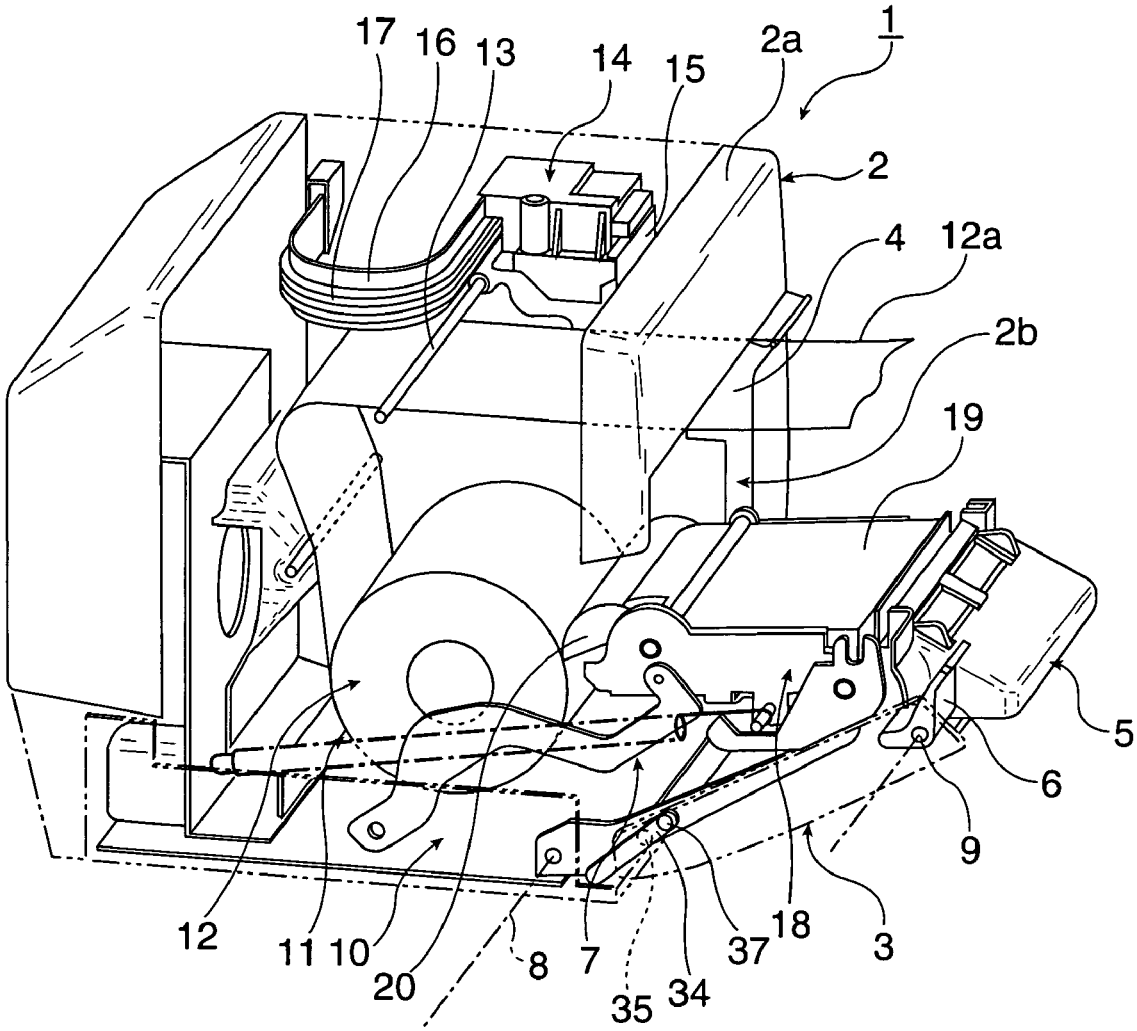
FIG. 2 shows the roll paper printer when the access cover is open.

FIG. 1 is an oblique external view showing an inkjet roll paper printer according to a first embodiment of the invention. FIG. 2 shows the main parts of the same printer with the cover open.

The roll paper printer 1 has a rectangular box-like case 2 and a cover 3 that opens and closes and is disposed to the front of the case 2. The cover unit 3 includes a cover 3*a* and the opening/closing mechanism of the cover 3*a*. A paper exit 4 of a specific width is formed at the front of the outside case 2*a* part of the printer case 2. An discharge guide 5 projects to the front from below the paper exit 4, and a cover opening lever 6 is disposed beside the discharge guide 5. A rectangular opening 2*b* for loading and removing roll paper is formed in the outside case 2*a* below the discharge guide 5 and cover opening lever 6, and this opening is closed by the cover 3.

Operating the cover opening lever 6 releases the lock holding the cover 3. When the discharge guide 5 is gripped by the fingers and pulled forward after unlocking the cover, a four-node parallel linkage mechanism 7 to which the cover 3 is attached enables the cover 3 to open forward to a substantially horizontal position by pivoting on a frame-side pivot axis 8 that extends horizontally widthwise to the printer at the bottom end of the cover 3. Opening the cover 3 also opens the roll paper compartment 11 rendered inside the printer and opens the paper transportation path travelling from the roll paper compartment 11 to the paper exit 4. As a result, replacing the roll paper 12 and performing other tasks from the front of the printer is simplified.

Figure 3:
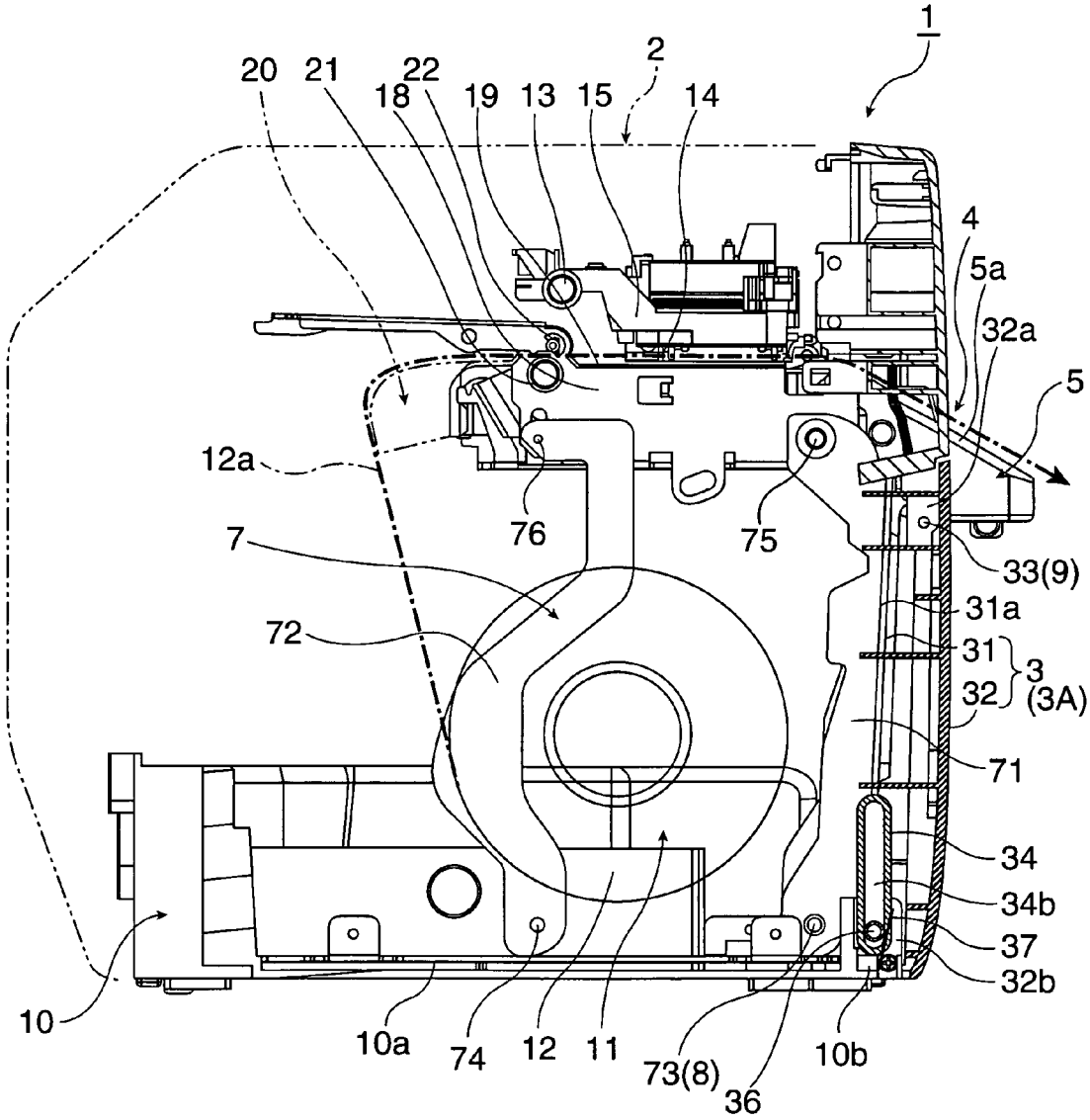
FIG. 3 is a partial section view showing the main parts of the roll paper printer when the access cover is closed.
Figure 4:
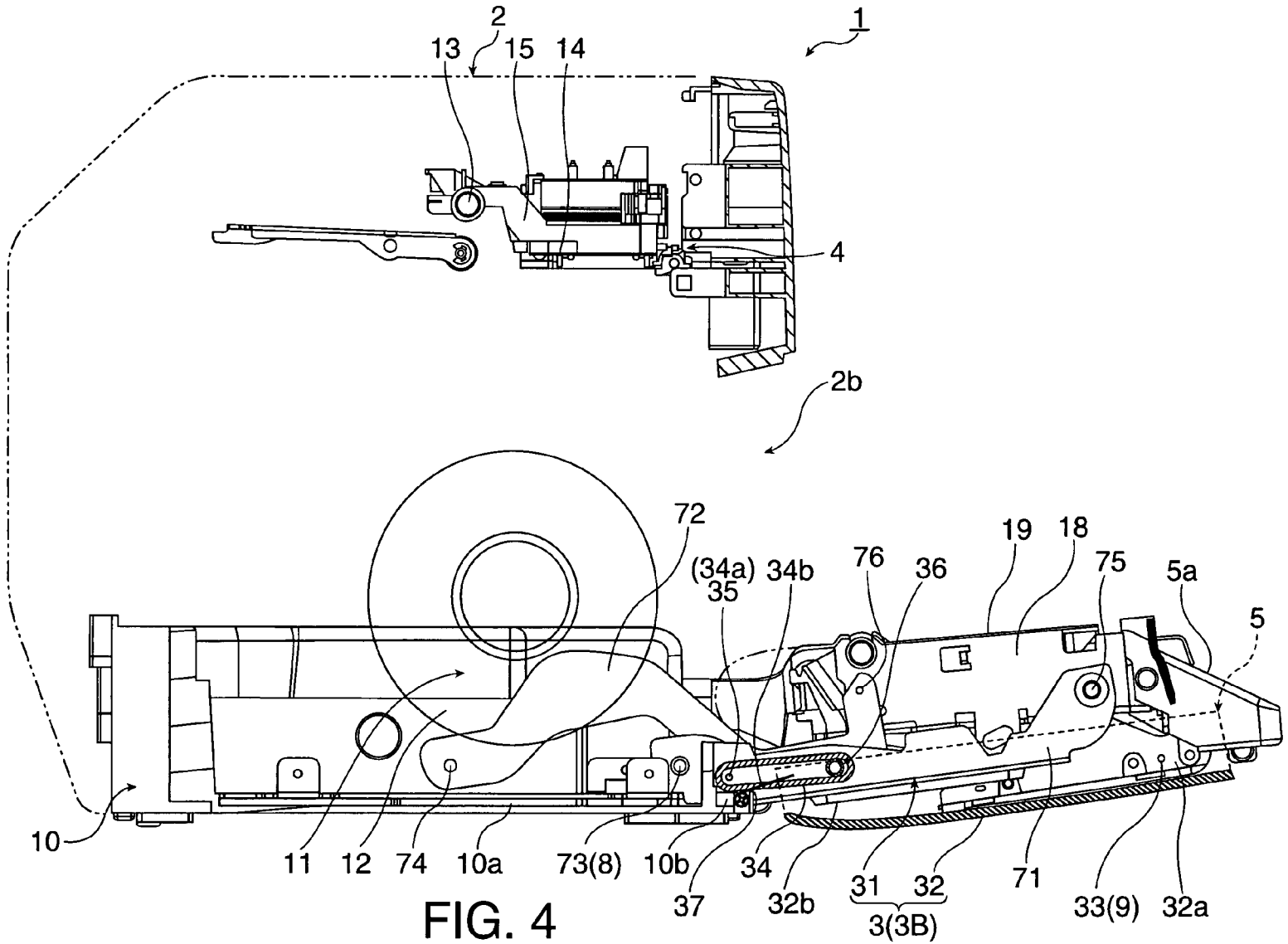
FIG. 4 is a partial section view showing the main parts of the roll paper printer when the access cover is open.

FIG. 3 is a partial section view showing the main parts of the roll paper printer when the access cover 3 is closed, and FIG. 4 is a partial section view showing the main parts of the roll paper printer when the access cover 3 is open.

As shown in FIG. 2 and FIG. 3, a roll paper compartment 11 is formed inside the roll paper printer 1 between the widthwise sides of the printer frame 10. The roll paper compartment 11 stores the roll paper 12 placed on its side between the side walls of the printer.

A carriage guide shaft 13 extends widthwise to the printer between the sides of the printer frame 10 at the top of the roll paper compartment 11. A carriage 15 on which an inkjet head 14 is disposed with the nozzles facing down travels back and forth widthwise to the printer on the carriage guide shaft 13. The carriage 15 is driven bidirectionally widthwise to the printer by a carriage transportation mechanism known from the literature, such as a carriage transportation mechanism having a carriage motor and a timing belt. A flexible printed circuit 16 is connected to the inkjet head 14 carried by the carriage 15, and drive signals, for example, are supplied to the inkjet head 14 through the flexible printed circuit 16. An ink supply tube group 17 is routed along the flexible printed circuit 16 for supplying selected colors of ink to the inkjet head 14 from an ink tank not shown.

A platen frame 18 extending horizontally in the front-back direction of the printer (also referred to as the longitudinal direction) is disposed between the inkjet head 14 and the roll paper compartment 11. A platen surface 19 is disposed to the top end of the platen frame 18 opposite the inkjet head 14 with a predetermined gap therebetween, and the platen surface 19 defines the printing position of the inkjet head 14.

A tension guide 20 that can pivot up and down is attached to the back end of the platen frame 18. A paper feed roller 21 extends horizontally widthwise to the printer behind the platen surface 19 on the platen frame 18. A pressure roller 22 pushes from above with predetermined force against the paper feed roller 21 with the printing paper 12*a* therebetween.

The paper feed roller 21 is driven by a paper feed motor not shown that is disposed to the printer frame 10.

The printing paper 12*a* pulled up and off the roll paper 12 stored in the roll paper compartment 11 curves to the front around the tension guide 20 as shown in FIG. 2 and FIG. 3, and travels from between the paper feed roller 21 and pressure roller 22 passed the inkjet head 14 and platen surface 19, and outside of the printer through the paper exit 4.

With the printing paper 12*a* thus loaded, the inkjet head 14 prints on the part of the surface of the printing paper 12*a* that is delivered from the roll paper 12 and is located at the printing position while the carriage 15 travels back and forth. After the process printing one line across the width of the printing paper 12*a* is completed, the printing paper 12*a* is advanced the predetermined pitch and the next line is then printed. The inkjet head 14 thus prints while the printing paper 12*a* is intermittently advanced a predetermined pitch.

A paper cutting mechanism such as a scissor-type paper cutter (not shown in the figure) is disposed to the paper exit 4 from which the printing paper 12*a* is discharged. This paper cutter cuts across the width of the printing paper 12*a* positioned in the paper cutter. After the paper is cut, the cut printed portion is discharged from the paper exit 4 and drops by its own weight along the discharge guide 5 toward a predetermined location.

Operating Mechanism for Opening and Closing the Cover

The mechanism for opening and closing the access cover 3 is described next with reference to FIG. 2, FIG. 3, and FIG. 4.

The cover 3 includes a sheet metal cover frame 31, and a plastic cover case 32 that is disposed covering the front of the cover frame 31. This cover 3 is supported to open and close by means of the four-node parallel linkage mechanism 7.

The four-node parallel linkage mechanism 7 includes a pair of left and right front parallel links 71, a pair of left and right rear parallel links 72, and the platen frame 18 that connects the top parts of the parallel links 71 and 72. A front panel 31*a* is disposed widthwise to the printer between the left and right front parallel links 71. The back side of the cover case 32 touches the front of this front panel 31*a*. The cover frame 31 in this embodiment of the invention is thus rendered by the front parallel links 71 disposed in unison with the front panel 31*a*.

The bottom end parts of the left and right front parallel links 71 are supported by the bottom panel part 10*a* of the printer frame 10 to pivot freely forward and back on a horizontal shaft 73 (frame-side pivot axis 8) extending widthwise to the printer. The left and right rear parallel links 72 are also supported by the bottom panel part 10*a* of the printer frame 10 to pivot freely forward and back on a horizontal shaft 74 extending widthwise to the printer.

The top end parts of the front parallel links 71 are connected freely pivotably on a horizontal shaft 75 extending widthwise to the printer at the front end parts of the platen frame 18. The top end parts of the rear parallel links 72 are connected freely pivotably on a horizontal shaft 76 extending widthwise to the printer at the back end parts of the platen frame 18.

The discharge guide 5 (moving member) is affixed to the front end part of the platen frame 18. When the cover 3 is closed, the distal end of the discharge guide 5 protrudes forward from the cover frame 31 of the cover 3, and the guide surface 5*a* of the discharge guide 5 slopes down in front of the printer from the paper exit 4.

The cover case 32 of the cover 3 is attached to the bottom end part of the discharge guide 5. More specifically, a horizontal shaft 33 extending horizontally widthwise to the printer is disposed to the bottom end part of the discharge guide 5, and the top end part 32*a* of the cover case 32 is disposed freely pivotably in the longitudinal direction on this horizontal shaft 33 (member-side pivot axis 9).

The bottom end part 32*b* of the cover case 32 extends to the bottom panel part 10*a* of the printer frame 10, and the bottom end part 32*b* is connected to the front end part 10*b* of the printer frame 10 of the printer frame 10 by an intervening connector arm 34.

The back end part 34*a* of the connector arm 34 is attached to the side of the printer at the front end part 10*b* of the printer frame 10 freely pivotably in the longitudinal direction on a support shaft 35 (first axis, see FIG. 4) disposed widthwise to the printer. This support shaft 35 is positioned in front of the horizontal shaft 73, which is the pivot axis of the front parallel links 71 of the parallel linkage mechanism 7. A slide channel 34*b* of a predetermined width and depth is formed along the length of the connector arm 34.

A slide pin 36 protruding widthwise to the printer is affixed to the side of the printer at the bottom end part 32*b* of the cover case 32. This slide pin 36 fits into the slide channel 34*b* of the connector arm 34 from the side, can slide along the slide channel 34*b*, and can pivot on the pivot axis (second axis) of the slide pin 36.

A torsion spring 37 is disposed to the support shaft 35 that is supported on the printer frame 10 and defines the pivot axis of the connector arm 34. This torsion spring 37 (urging member) constantly applies an urging force to the connector arm 34 in the direction opposite the direction in which the connector arm 34 opens to the front of the printer.

Operation of the Opening and Closing Access Cover

When the cover 3 is in the upright closed position 3A (see FIG. 3), the slide pin 36 on the side of the cover case 32 is positioned at the bottom end of the slide channel 34*b* in the connector arm 34. The connector arm 34 is held in the upright vertical position by the urging force of the torsion spring 37. When the cover 3 is unlocked and the discharge guide 5 is pulled forward, the cover frame 31 of the cover 3 tilts forward pivoting on the horizontal shaft 73 at the bottom end part thereof. The discharge guide 5 positioned at the top end of the cover 3 also moves forward in conjunction with the platen frame 18 while held in substantially the same posture by the four-node parallel linkage mechanism 7.

The cover frame 31 of the cover 3 pivots forward on the horizontal shaft 73 with the front parallel links 71 of the four-node parallel linkage mechanism 7. Because the top end part 32*a* of the cover case 32 is attached to the discharge guide 5 so that it can pivot freely front-back on the horizontal shaft 33 at the side of the discharge guide 5, the cover case 32 moves forward together with the discharge guide 5. As a result, when the cover 3 is opened, the cover case 32 moves while sliding upward relative to the cover frame 31. In conjunction therewith, the slide pin 36 fixed to the bottom end part 32*b* of the cover case 32 slides up along the slide channel 34*b* in the connector arm 34. Because the connector arm 34 is constantly urged to the back by the torsion spring 37, the bottom end part 32*b* of the cover case 32 is constantly held pressed to the cover frame 31 side by the connector arm 34 and the torsion spring 37. The cover case 32 therefore moves without separating from the cover frame 31 to the open position 3B shown in FIG. 4.

Effect of this Cover Operating Mechanism

As described above, because the top end part 32*a* of the cover case 32 is connected to discharge guide 5 and moves together with the discharge guide 5 by means of the cover operating mechanism for a roll paper printer 1 according to this embodiment of the invention, the gap between the bottom end part 32*b* of the cover case 32 and the bottom end part of the discharge guide 5 does not widen when the cover 3 opens and closes. Dust and other foreign matter therefore does not enter the roll paper compartment through this gap. The air flow produced by a fan not shown disposed inside the printer can circulate inside the printer without leaking from this gap, and can prevent a rise in temperature.

Furthermore, compared with the related art wherein the cover case 32 opens forward in unison with the cover frame 31 pivoting on the same horizontal shaft 73, the cover case 32 in this embodiment of the invention is pressed against the cover frame 31 while hanging suspended from the discharge guide 5, which holds the same posture while moving forward, and less space is therefore needed for the cover 3 to open and close.

In addition, the four-node parallel linkage mechanism 7 holds the platen frame 18 and discharge guide 5 level as they open in conjunction with the cover 3 in this embodiment of the invention. Opening the cover 3 thus opens a wide opening 2*b* to the roll paper compartment 11 and replacing the roll paper 12, for example, is easier.

The invention is described above using an inkjet roll paper printer by way of example, but the invention can also be applied to printers using a thermal print head or other type of print head.

Furthermore, while one end of the connector arm 34 is connected to the side of the printer frame 10 in the foregoing embodiment, the connector arm 34 may be connected to the cover frame 31 side.

Yet further, the connector arm 34 is pivotably attached to the side of the printer frame 10, and the slide pin 36 is disposed to the cover case 32 side in the foregoing embodiment, but it is also conceivable to render the slide pin 36 on the printer frame 10 or the cover frame 31 side and dispose the connector arm 34 to the cover case 32 side.

Yet further, a torsion spring 37 is used in the foregoing embodiment as the urging member that presses the cover case 32 to the cover frame 31, but a different type of urging member may obviously be used instead.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An operating mechanism for a cover of a printer, comprising:

an operating cover for opening and closing an opening formed in the printer; and a moving member that moves in conjunction with the operating cover; the operating cover including a cover frame that opens and closes pivotably on a frame-side pivot axis of the printer, a cover case that covers the cover frame, and an urging member that urges the cover case toward the cover frame; wherein the cover case is pivotably attached to the moving member so that the cover case pivots toward and away from the cover frame on a member-side pivot axis of the moving member parallel to the frame-side pivot axis.

2. The operating mechanism for a printer cover described in claim 1, further comprising: a connector arm connecting the cover case to the printer or cover frame, wherein the connector arm is pivotably connected to the printer or cover frame on a first axis that is parallel to the frame-side pivot axis, the connector arm is connected to the cover case pivotably on a second axis that is parallel to the member-side pivot axis and movably bidirectionally in a direction perpendicular to the member-side pivot axis; and the urging member urges the cover case through the intervening connector arm.

3. The operating mechanism for a printer cover described in claim 2, wherein: the cover case or the connector arm has a slide channel; and the other of the cover case and the connector arm has a slide pin that is inserted pivotably and slidably in the slide channel.

4. The operating mechanism for a printer cover described in claim 1, further comprising: a four-node parallel linkage mechanism including front parallel links, back parallel links, and a connection frame spanning between end parts of the front parallel links and end parts of the back parallel links; wherein the parallel linkage mechanism enables opening and closing the operating cover between a vertical upright closed position and an open position tilted to the printer front; the cover frame is attached to the front parallel links; and the moving member is attached to the front end part of the connection frame.

5. The operating mechanism for a printer cover described in claim 4, wherein: the connection frame is a platen frame having a platen surface; the moving member is a discharge guide attached to the front end part of the platen frame; and when the operating cover is closed, the platen surface is opposite a print head disposed to the printer, and the discharge guide can guide the printing paper after the paper is printed.

6. The operating mechanism for a printer cover described in claim 5, wherein: the opening is an opening to a roll paper compartment formed inside the printer.

7. A roll paper printer comprising the operating mechanism for a printer cover described in claim 1.

8. A printer comprising:

an operating cover for opening and closing an opening; and a moving member that moves in conjunction with the operating cover;

the operating cover including a cover frame that opens and closes pivotably on a frame-side shaft on the printer, a cover case that covers the cover frame, and an urging member that urges the cover case toward the cover frame; and wherein the cover case is pivotably attached to the moving member so that the cover case pivots toward and away from the cover frame on a member-side shaft of the moving member.

9. The printer described in claim 8, further comprising: a connector arm connecting the cover case to the printer or cover frame, the connector arm being pivotably connected to the printer or cover frame on a first axis that is parallel to the axis of the frame-side shaft.

10. The printer described in claim 9, wherein: the connector arm is connected to the cover case pivotably on a second axis that is parallel to the axis of the member-side shaft and movably bidirectionally in a direction perpendicular to the member-side pivot axis.

11. The printer described in claim 10, wherein: the urging member urges the cover case through the intervening connector arm.

12. The printer described in claim 11, wherein: the cover case or the connector arm has a slide channel; and the other of the cover case and the connector arm has a slide pin that is inserted pivotably and slidably in the slide channel.

13. The printer described in claim 8, further comprising: a four-node parallel linkage mechanism including front parallel links, back parallel links, and a connection frame spanning between end parts of the front parallel links and end parts of the back parallel links; wherein the parallel linkage mechanism enables opening and closing the operating cover between a vertical upright closed position and an open position tilted to the printer front.

14. The printer described in claim 13, wherein: the cover frame is attached to the front parallel links; and the moving member is attached to the front end part of the connection frame.

15. The printer described in claim 13, wherein: the connection frame is a platen frame having a platen surface; the moving member is a discharge guide attached to the front end part of the platen frame; and when the operating cover is closed, the platen surface is opposite a print head disposed to the printer, and the discharge guide can guide the printing paper after the paper is printed.

* * * * *